United States Patent [19]

Wells

[11] Patent Number: 4,574,774

[45] Date of Patent: Mar. 11, 1986

[54] FIREPLACE ACCESSORY

[76] Inventor: Harold D. Wells, 14015 Margaux La., Chesterfield, Mo. 63017

[21] Appl. No.: 658,662

[22] Filed: Oct. 9, 1984

[51] Int. Cl.[4] ..... F23H 13/00

[52] U.S. Cl. ..... 126/164; 126/165; 126/163 R

[58] Field of Search ..... 126/164, 163 R, 160, 126/161, 152 B, 152 R, 165, 274

[56] References Cited

U.S. PATENT DOCUMENTS

| | | | |
|---|---|---|---|
| 230,389 | 7/1880 | Adair | 126/164 |
| 1,491,570 | 4/1924 | Thornblade | 126/274 X |
| 2,891,465 | 6/1959 | Rogge | 126/274 X |
| 3,026,866 | 3/1962 | Lynch | 126/274 |
| 3,213,846 | 10/1965 | Rogers, Jr. et al. | 126/164 X |
| 3,289,667 | 12/1966 | Nelson | 126/165 |

FOREIGN PATENT DOCUMENTS

| | | | |
|---|---|---|---|
| 5563 | of 1884 | United Kingdom | 126/164 |

*Primary Examiner*—Randall L. Green

*Attorney, Agent, or Firm*—Haverstock, Garrett & Roberts

[57] ABSTRACT

A fireplace accessory serves as a combustion efficiency improvement device. The structure is a tubular element open along a front side and in the form of an arch lying upon its side for partially enveloping logs or other fuel. A horizontal combustion region is provided within the structure for at least partial exposure of the fuel through the frontal opening by the structure, the frontal opening facing toward a room area to be heated by the burning fuel. The arch configuration both cradles the fuel and insulatively and radiantly encloses it. A double-walled configuration, preferably curved stainless steel sheets with thermally insulating, refractory material between them, defines an interior surface which becomes heated to and is maintained by the combustion at extraordinarily high temperatures. This causes radiation of thermal energy forwardly from the interior surface for intensifying combustion of the fuel, for causing substantially complete burning of volatiles released by the fuel during combustion, and for redirecting thermal energy generated by the combustion through the opening into the room area to be heated. End plates support the tubular element in horizontal orientation.

11 Claims, 4 Drawing Figures

FIREPLACE ACCESSORY

BACKGROUND AND SUMMARY OF THE INVENTION

This invention relates to a fireplace accessory and, more specifically, to a device for improving the efficiency of burning of logs and other comparable fuels, such as paper logs, artificial logs, charcoal, lignocellulosic and carbonaceous fuels, and other fossil fuels, but most preferably as when burning logs in a fireplace of the wood-burning type.

Myriad devices have been proposed for relocating or confining the combustion normally occurring in a fireplace, such as by moving the combustion zone outwardly from the fireplace within an enclosed chamber from which improved radiation may be obtained. A well-known example of historic origin is the Franklin stove.

Still other proposals have been made for enshrouding, partially enclosing, or otherwise providing heating chambers in or surrounding the fireplace chamber, mantle, or grate.

Arrangements have been proposed, too, for positioning combustible fuel, such as logs, in such a way (as by stacking of logs) that air is more likely to be made available to the logs for combustion or so that radiating surfaces of the burning logs are oriented toward the fireplace opening.

Other devices have involved the use of various forms of ducting, such as using large tubes shaped in the form of a grate to permit air to be drawn into the fireplace through the tubes, heated, and discharged from opposite ends of the tubes into the adjacent room.

The foregoing devices fail in various ways to enhance the combustion efficiency of typical fireplace fuels, i.e., logs, newspaper rolls, etc. Many such lignocellulosic fuels contain volatiles which cause production of off-gases rising uselessly up the fireplace. More objectionably, they may be deposited as tars, condensates and soot in the chimney, causing a fire risk and necessitating periodic chimney cleaning.

Among the prior art also must be noted the use of a heavy cast iron plate called a "fireback" for lining the back of a fireplace, such plate being typically upright and also being heated as fuels are being burned in the fireplace. The term "arch" has been applied to an ignition tunnel of insulative brick through which coal is conveyed to a boiler combustion chamber, the brick causing the coal to be more quickly brought up to ignition temperature.

Among problems of such prior art devices include the failure to permit the heat achieved during combustion to be radiated outwardly from the zone of combustion in an efficient, focussed, or useful way, whereby a disproportionate, wasteful quantity of the heat generated by the process of combustion within the fireplace is irretrievably lost up the chimney.

Ordinary fireplace grates, cradles, firebacks, inserts and the like do not typically facilitate lighting or ignition of logs or do not necessarily make it easier to get a fire started. But this is particularly so if one is attempting to ignite a single log. It is common knowledge that one must stack two or three logs together in order to make it easier to get any one of the logs to begin burning.

Accordingly, it is an object of the invention to provide a fireplace accessory constituting a device for enhancing the efficiency of combustion of various fuels, and especially those typically burned in fireplaces, and especially logs.

Also an object of the present invention is to provide such an accessory which allows a user to burn a single log in a most effective manner without having to resort to starting the fire with multiple logs or to keep adding logs to maintain combustion.

It is another object of the invention to provide an accessory of the character stated for directing heat of combustion from a normal zone of combustion, such as outwardly from a fireplace.

It is yet another object of the invention to provide an accessory of the character stated which, by virtue of its thermal characteristics, is itself of a heat-radiating character, whereby when heated by the combustion fuels, it becomes hot for emitting radiation therefrom outwardly from a zone of combustion.

Another object of the invention is the provision of an accessory of the character stated which allows far greater fireplace combustion efficiency for typical lignocellulosic fireplace fuels, by achieving the burning of off-gases released during the combustion of such fuels.

It is yet another object of the invention to provide an accessory of the character stated which may be utilized in existing fireplaces, without the need for modification thereof, and which similarly avoids the need for andirons, fire grates, etc. within the fireplace.

Another object of the invention is the provision of an accessory of the character stated which provides an improved pattern of radiation of heat from a fireplace into an adjacent room to extract a greater amount of heat from the fireplace than otherwise would be obtained.

Another object of the invention is the provision of an accessory of the character stated which provides enhanced comfort for room occupants.

An object of the present invention is also to provide a novel method and arrangement of igniting fuels as well as smoke, gases and volatiles which are released by such fuels when burned by the use of a unique ignition arch concept of the invention.

Among still other objects of the invention may be noted the provision of such a device which is extremely simply constructed, utilizing very few separate parts and elements to provide an easily, rapidly, and economically manufactured device, utilizing relatively low-cost, long-lasting materials.

Other objects will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
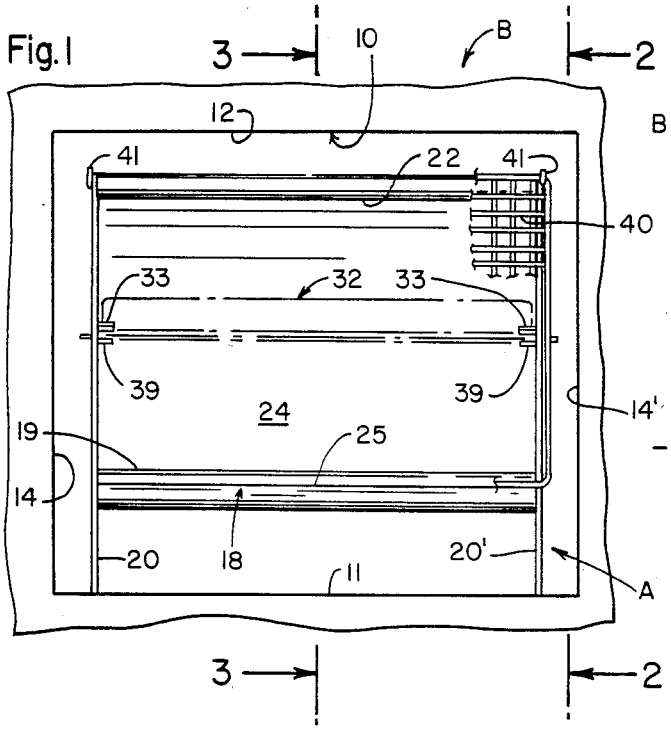
FIG. 1 is a front elevation of a fireplace in which is located a fireplace accessory constructed in accordance with and embodying the present invention.

Referring now to the drawings by reference character, indicated generally at A is a fireplace accessory or combustion efficiency improvement device of the present invention. Apparatus A is installed within a fireplace B having the usual rectangular opening 10 divided by a hearth 11, upper edge or lintel 12 and side walls as at 14, 14'. The upper edge 12 extends upwardly into the usual flue opening 15 (FIG. 3) which extends up into the chimney per se, and with there being the customary rear wall 16 from which said device A is shown spaced slightly forward toward said opening.

Although primarily intended as a fireplace accessory, device A is portable and self-contained and so may be utilized in a stand-alone mode, as for outdoors use or when used in conjunction with the free-form, modernistic open hearth fireplace which customarily has only a pedestal-like hearth over which there is a hood but without walls in the customary sense. As will be apparent, device A is especially advantageously used in fireplaces such as the customary fireplace of the character shown.

However utilized or located, device A is intended to partially surround and, thus, envelope wood logs or other piece fuels, such as paper, or composite logs or other artificial logs, as well as charcoal and any of a wide variety of possible lignocellulosic and carbonaceous fuels, but with the primary advantages of the invention being best realized by making use of device A for burning customary wood logs or, as will appear, even a single log.

Regardless of the type of fuel to be utilized, whether to be a single log, multiple logs, or discrete pieces of fuel, combustion is carried out within an envelope or arch structure which is designated generally in its entirety at 18.

Said arch structure 18 includes a rectangular frontal opening 19 along its length and is supported at opposite ends by end pieces of plate-like character, designated at 20, 20'. In cross section, structure 18 is of the form of an arch lying upon its side and whereby it opens outwardly at 19; and is hereinbelow accordingly termed an arch. Its curvature provides a bed or floor 21 on which may be seated one or more pieces of fuel f, such as logs as illustrated in phantom. Briefly, before discussing other features of the invention, it is noted that combustion of such fuel f takes place entirely within the curvature of arch 19 with gases resulting from combustion as well as the combustion products of a gaseous nature rising internally within the C-shaped configuration of the arch and around an upper lip or edge 22 and thence rising upwardly to said flue opening 15.

Arch 18 is of a double-walled sandwich-like character, being comprised of a continuous inner surface or wall 24 of continuously curving nature and integrally joined, as by welding, at the upper edge 22 and also at a lower edge 25', both of rounded character, to a similarly continuously curved outer surface or wall 25.

Both the interior wall 24 and exterior wall 25 are preferably constitued of a stainless steel alloy, such as most especially that having a high nickel and chromium content so as to be capable of withstanding extremely high temperatures over long periods of usage, such as up to about 1800° F. or more, and 304-stainless steel is but one alloy grade which may be utilized. Filling the interior space between the inner and outer walls 24, 25 is a layer of highly thermally insulative, refractory material such as, for example, a blanket of a fibrous refractory material such as most preferably that sold under the trade names FIBERFAX DURABLANKET or FIBERFRAX DURABACK manufactured by Carborundum Company of Niagara Falls, N.Y. These materials are essentially a fibrous form of high temperature refractory insulation consisting essentially of alumina and silica, and specifically from about 50 percent to about 60 percent silica ($SiO_2$) and from about 37 percent to about 50 percent alumina ($Al_2O_3$).

The overall thickness of arch 18 may be from about 0.5 in. to about 3.0 in., depending on the ultimate temperatures to be realized. Inner wall 24 is most preferably relatively thin, e.g., 30-gauge, and rear wall 25 may be of comparable thickness. Thus, inner wall 24 has a relatively low physical and thermal mass and accordingly will heat up very quickly when combustion of fuel f is initiated. The surface character of the insulative layer 26 is not of critical significance but is most preferrably light or even white-colored and relatively rough in texture to enhance its thermally insulative properties by minimizing surface contact with the opposed blanket-contacting surface of inner wall 24.

Thermally insulating, refractory materials of such character may provide a density within a generally preferred range of about 4 to 8 lb./ft.$^2$ and capable of tolerating temperatures readily up to 1500°–2300° F. on a continuously maintained basis and, thus, well within the range of temperatures, even the most excessive temperatures, which can be produced by the burning of conventional lignocellulosic or carbonaceous fireplace fuels.

Provided above the length of said floor or seat 21 is a slot s in which is seated a basket 28 of rectangular cross-section in the floor of which are formed numerous elongated transverse slots 29 which are of a relatively long, thin configuration, the same being evenly spaced along the length of basket 28. Slots 29 serve as vents for the entry of air for combustion for burning of fuel f. The number of such apertures as well as their widths may be a matter of design choice. Basket 28 is of sufficient width and depth for receiving pieces of charcoal or kindling for facilitating lighting of fuel f and yet its slots 29 permit ash to readily fall through the basket and onto the fireplace hearth 11. Basket 28 is most preferably formed with flanges 28' along its upper side edges whereby it is readily removable from slot s, as for cleaning or replacement, etc. Basket 28 may be formed similarly of stainless steel or other steel alloys.

Arch 18 is carried by said end plates 20, 20' which are most preferably of stainless steel or other steel alloys. These end plates are flat, and are welded along the periphery of the opposite ends of arch 18 of both inner and outer walls 24, 25, thereby to fully enclose the void or interior space in which said insulative blanket 26 is located. Although such space containing blanket 26 may be completely closed as illustrated, such is not intended to preclude providing small heat-relieving vents therein, e.g., opening through the outer wall 25 proximate its upper edge, as for permitting escape of gas therein when arch 18 undergoes substantial increase as will occur during combustion.

Figure 2:
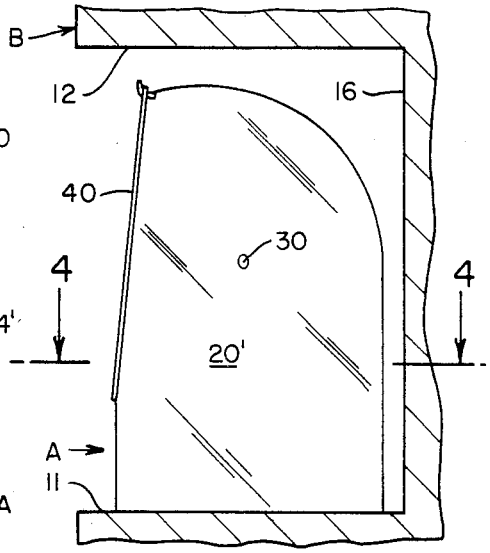
FIG. 2 is a vertical cross-section, as taken within the fireplace along the line 2—2 of FIG. 1 to provide a right side elevation view of the new accessory.

Most preferably, end plates 20, 20' are of a continuous, solid sheet-like character, but may be double-walled. They may also be provided with apertures, as at 30 (FIG. 2), in central regions thereof to permit a spit to be inserted through the oven for turning of meat products if the new device is utilized, as it may be, for cooking or broiling, as an auxiliary mode of usage.

Designated in its entirety generally at 32 is a removable, optional accessory which may be used, only when desired, to facilitate the initiation of combustion or to permit a small log or other small pieces of fuel to be burned. Accessory 32 is of elongated, arcuate or lenticular character, being supported centrally within by pairs of tabs 33 projecting inwardly from inner face of opposite end plates 20, 20' such that accessory 32 is supported upon them.

Figure 3:
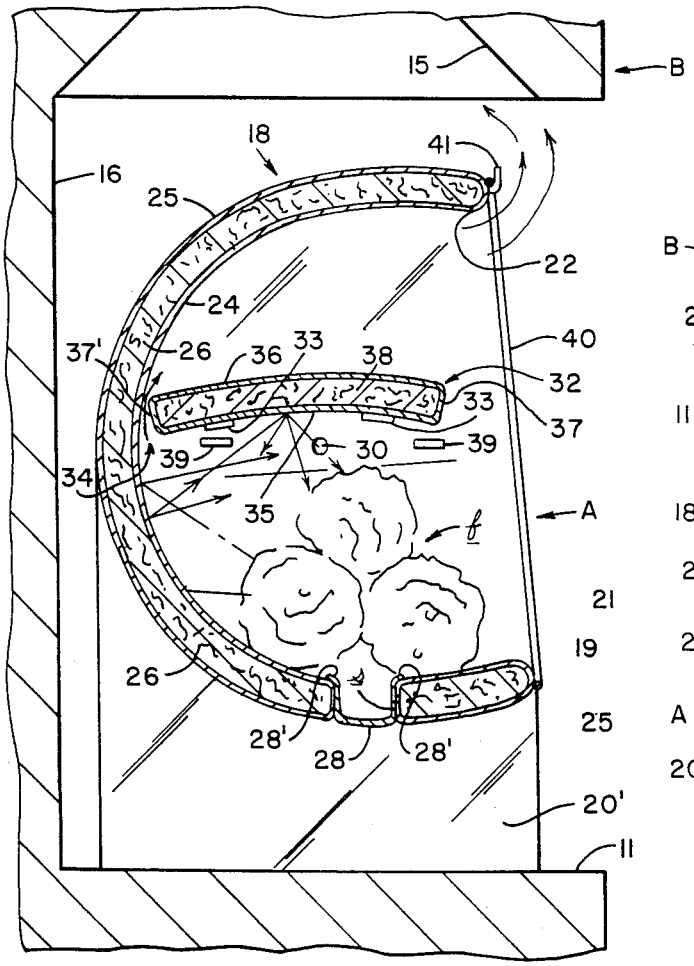
FIG. 3 is a vertical cross-section of the device, as taken generally along the line 3—3 of FIG. 1.
Figure 4:
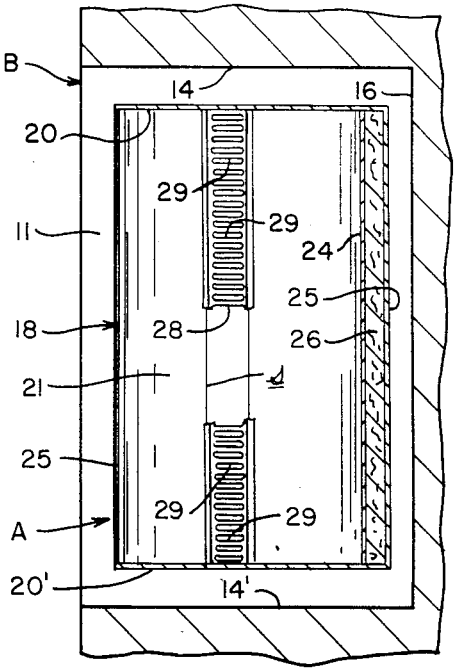
FIG. 4 is a horizontal cross-section of the device, as taken generally along the line 4—4 of FIG. 2.

As shown in FIG. 3, a gap 34 is provided between the rear-most portion of accessory 32 and inner wall 24 of the arch for an important purpose which shortly will be explained.

Accessory 32 has substantially the same sandwich-like character of arch 18, being provided with a bottom surface 35 and upper surface 36 which are joined at side edges 37, 37', which are of smoothly rounded character as with the edges 22, 25' of the arch. The arcuate cross sectional configuration of accessory 32 is comparable to the arcuate cross-section of arch 18 and for the same reason, namely to facilitate the concentration of thermal energy relative to the location in which combustion of fuel f is taking place. Thus also, the outer surfaces 35, 36 of accessory 32 are formed of the same temperature resistant material as the inner wall 24 of the arch, such as high temperature-resistant stainless steel. Similarly, the interior of accessory 32 has identical refractory material.

Also shown projecting inwardly from the faces of end plate 20, 20' are tabs 39 which may be used, if desired, to support a grill (not shown) should accessory A be used for cooking rather than for its primarily intended purpose.

It should be understood that accessory 32, being optional in character, is merely installed for facilitating the starting of a fire or, as noted, for permitting small logs or pieces of fuel to be burned more readily than would be the case without accessory 32 being present. Due to the proximity of accessory 32 to fuel f, its lower surface 35 will readily radiate thermal energy (as shown with phantom line indications) toward said fuel f and thereby refocus and redirect heat of combustion upon the surface of fuel f to enhance the combustion process. However, because of said gap 34, it will be apparent that heat as well as the gaseous products of combustion will in part escape upwardly through such gap as shown by arrows and thereby cause the surfaces of the inner wall 24 above said accessory 32 to be heated by the rising gases so that when accessory 32 is removed, these upper positions of wall 24 will already be sufficiently hot to radiate heat back toward the burning fuel f and also on through the frontal opening 19. Of course, such surfaces of inner wall 24 below accessory 32 as are immediately proximate the burning fuel f are directly heated by the combustion process. In the absence of accessory 32, radiation from the burning fuel f would readily reach all portions of the inner wall 24 for directly heating them.

Extending across the full width and height of opening 19 is a grill 40 of rectangular configuration. Grill 40 formed of closely spaced horizontal and vertical grid members. But the grid members are merely representative, as grill 40 may instead be formed of a perforate plate, screen or other foraminous material. However, the material of construction of the grill is a highly temperature resistant alloy such as most preferably of a stainless steel.

Provided at the outer ends of arch 22 are a pair of upwardly oriented hooks 41 which grill 40 may be engaged and suspended thereby permitting same to be pulled outward by swinging on said hooks by adding logs or fuels to said device A. Grill 40 permits outward radiation of heat from within device A not only for the outward infrared radiation while permitting the fire to be seen as desired, but also serves other important functions explained below.

In operation, the interior surfaces of device A all become extremely hot, taking on elevated temperatures comparable to those of the combustion process itself, in view of the thermally isolated character of the inner wall 24. The inner wall 24 and other inner surfaces are poorly reflective and absorb thermal radiation. Thus, if heated, such inner surfaces are thermally emissive in character. Accordingly, not only is there heating of the inner surfaces, but there also is emission of thermal radiation through opening 19 and its overlying grill 40 and thence into the adjacent room or area. In the absence of accessory 32, a large percentage of the thermal energy resulting from the combustion process is outwardly directed from the new device A. Such outward infrared radiation is far in excess of that typically radiated by any fireplaces, fireplace inserts, firebacks, Franklin stoves, and other grates, grills and accessories. In other words, there is a provided novel effect of heat being outwardly-focussed and directed by the inner wall 24, which has taken on temperatures hitherto unreachable and unrealized within the field of fireplace accessories and devices, whether they be fireplace inserts, stoves, firebacks, grills or whatever. The net effect is one of an extraordinary heat being transferred by the new device from the combustion process into the adjacent room or area. However, as noted, because of the poorly reflective character of inner wall 24, as well as because of the high temperature to which it has been heated by the combustion process by direct absorbtion from the burning of fuel f, infrared radiation is also emitted back toward the fuel f, thereby enhancing and intensifying the combustion process itself in an entirely novel manner. Consequently, combustion proceeds in a vastly more efficient manner than previously attainable, and even to the extent of permitting a single log to burn in a continuous manner even though not nested or stacked with adjacent logs as has been customarily assumed to be necessary.

Further, a novel effect occurs along the interior surfaces of inner wall 24. There, a boundary layer of extreme high temperature causes virtually complete combustion of volatiles and other gases released during the combustion process, such as, for example, the typical pyroligneous gases which emanate from heated and burning lignocellulosic fuels, and including aldehydes, methanes, formaldehydes, formic acids, ethylene, butylene, propylene, as well as carbon monoxide, carbon dioxide, hydrogen and many other compositions and fractions. A scrubbing action of the rising gases of proximate interior surfaces of arch inner wall 24 prevents the deposit of tars, creosote, or carbon in such an effective manner that combustion is complete before the gases emerge from the top of the arch and pass around its upper lip 22 for entrance into flue 15. Ordinarily, of course, such gases would be incompletely burned, if at all, in typical fireplace combustion wherein they are discharged through the chimney flue or deposited in the chimney or emerge from the chimney with dense residual smoke. But with the new device, combustion of such gases not only eliminates deposit of tars, creosote, etc., but also provides another source of combustion heat which radiates into the adjacent room or area both by reflection from the inner wall and by an increased heating of the inner wall, from which there is outwardly directed infrared radiation.

Grill 40, by its proximity to the high temperatures not only of combustion fuel f and its off-gases, is similarly heated to very high temperatures. Its radiation, both outwardly and inwardly, provides the advantages of further room heating while tending to stabilize the combustion process. In addition, grill 40 supresses sparks which are given off by the burning fuel.

Accordingly, arch 18 and its associated structure do not form primarily a reflector or mere redirector of heat but instead constitute a structure of a shape which will refocus, confine and intensify the combustion process, thereby resulting in the structure taking on sufficient temperatures that thermal radiation is directed outwardly from its surfaces and is thereby transferred into the adjacent room or area.

In usage of the new device A, the user may prefer to insert optional accessory 32 for accelerating the ignition process, thereby confining the combustion region, yet with hot gases rising through space 34 to preheat the surfaces of wall 24 above accessory 32. Then, when combustion has developed and reached a self-sustaining point, accessory 32 may be lifted out with the use of tongs and operation from that point forward is best carried out without further use of accessory 32.

Device A does not interfere with the usual drawing of smoke and combustion products through chimney flue 15, as the gaseous combustion products simply rise along the inner wall 24 and around its curved upper edge 22, with the walls 20, 20' confining the rising gases for as long as possible within the interior of the arch.

But in addition, a further function of the device is blanketing, entrapment, and confinement of heat around the combustion zone to prevent the fireplace roof and back wall 16 of fireplace B from being heated as otherwise they would. As might well be recognized, these brick or masonry surfaces of the fireplace have a large thermal mass, being such as to essentially cause very slow, inefficient absorption of heat over a long period of time, even though heat is liberated quickly during burning. Thus, the ordinary fireplace does not serve meaningfully to redirect said heat outwardly into the adjacent room. In comparison, device A provides the advantageous effect of localizing, confining, and usefully redirecting the heat occurring during combustion in the fireplace, further contributing to its efficacy in enhancing combustion in the fireplace.

An auxiliary benefit of using device A is that it protects the back wall 16 of fireplace B from thermal stresses and high direct heat, thus tending to prolong the life of the fireplace.

Accordingly, it is to be appreciated that the new device achieves the enhancement of combustion within the combustion zone in various ways: first, by emitting heat from said zone of combustion; second, by serving as a source of infrared energy as it reradiates outwardly into the room adjacent to the fireplace; and third and very significantly, by igniting combustible off-gases liberated from the heating and burning of lignocellulosic or other organic fuel materials within said zone of combustion. These functions result from the new stucture cradling and insulatively and radiantly enclosing the fuel. Accordingly, it is seen that the several objects of the invention are achieved and other advantageous results are also attained.

Although the foregoing includes a description of the best mode contemplated for carrying out the invention, various modifications and improvements are contemplated. For example, one or more of various catalysts could be applied to the inner wall 24 or to grill 40 in order to further enhance operation, as by more efficiently and completely burning volatiles liberated from the fuel during burning, or to permit operation at temperatures less than those normally expected during operation of the new device, such as typically 1100° F. up to conceivably 1700° F.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A combustion efficiency and ignition improvement device for enhancing combustion of fuel such as wood, carbonaceous fuel, or the like, said device comprising a housing constructed of relatively thin, heat absorbing material, means supporting said housing in an elevated position, said housing including a first generally C-shaped member having a generally vertically extending, curved, back portion and generally horizontally extending, curved, upper and lower portions, each of said upper and lower portions having a forward end and a rearward end, said lower portion being substantially subjacent said upper portion and being adapted to support fuel to be burned beneath said upper portion, said back portion being integral with and connecting said rearward ends of said upper and lower portions, said housing further including a forward opening adjacent and between said forward ends of said upper and lower portions, said back portion with said upper and lower portions defining a smooth, continuous, C-shaped interior surface for absorbing heat from fuel being burned and focusing and radiating heat forwardly through said forward opening and towards the fuel being burned on said lower portion, and heat insulating material positioned along substantially the full outer periphery of said first C-shaped member.

2. The device of claim 1 wherein said housing is constructed of steel and further including a second C-shaped member spaced from and positioned about and complementary to said outer periphery of said first C-shaped member, said second C-shaped member having upper and lower portions each having a forward end, said heat insulating materials including refractory materials positioned in the space between said first and second C-shaped members, substantially along the full length and width thereof.

3. The device of claim 2 wherein said lower portions of said first and second C-shaped members have draft openings therein for directing ambient air towards the fuel supported on said lower portion of said first C-shaped member.

4. The device of claim 2 wherein said means supporting said housing includes a pair of side walls, one of said side walls fixed on each lateral side of said C-shaped members, said side walls closing the space between said first and second C-shaped members and extending below said second C-shaped member to support said housing in an elevated position, and said side walls extending between said back, upper and lower portions on each lateral side of said housing.

5. The device of claim 4 wherein said forward ends of said upper and lower portions of said first C-shaped member are connected to said forward ends of said upper and lower portions, respectively, of said second C-shaped member to form a smooth, curved junction therebetween and to encase said heat insulating material.

6. The device of claim 5 wherein said housing is constructed of stainless steel and said heat insulating material comprises a refractory material of alumina and silica.

7. The device of claim 6 wherein said draft openings in said lower portions of said first and second C-shaped members are laterally extending slots, the device further including a laterally extending, vented basket projecting upwardly through said slots and downwardly below said second C-shaped member.

8. The device of claim 7 further including a grid-like grill spanning said forward opening in said housing.

9. The device of claim 1 further including a generally horizontal extending ignition aid assembly constructed of heat absorbing materials, said ignition aid assembly including upper and lower members having a space therebetween, heat insulating refractory materials positioned in said space, said lower member being curved and having forward and rearward end portions curved downwardly toward said lower portion of said C-shaped member to focus and radiate absorbed heat downwardly toward said lower portion and the fuel being burned thereon, and means removably supporting said ignition aid assembly on said device.

10. A combustion efficiency and ignition improvement device for enhancing combustion of fuel such as wood, carbonaceous fuel, or the like, said device comprising a housing constructed of heat absorbing material, means supporting said housing in an elevated position, said housing including a generally C-shaped member having a generally vertically extending, back portion and generally horizontally extending, upper and lower portions, each of said upper and lower portions having a forward end and a rearward end, said lower portion being substantially subjacent said upper portion and being adapted to support fuel to be burned beneath said upper portion, said back portion connecting said rearward ends of said upper and lower portions, said housing further including a forward opening adjacent and between said forward ends of said upper and lower portions, said back portion with said upper and lower portions defining a C-shaped interior surface for absorbing heat from fuel being burned and radiating heat forwardly through said forward opening, heat insulating material positioned along substantially the full periphery of said C-shaped member on the opposite side thereof from the interior surface, and a generally horizontally extending ignition aid assembly constructed of heat absorbing material, said assembly being substantially co-extensive with and opposed to said lower portion of said C-shaped member and interposed between said upper and lower portions, said ignition aid assembly including upper and lower members having a space therebetween, heat insulating refractory materials positioned in said space, said ignition aid assembly interposed between said upper and lower portions to block movement of heat in an upwardly direction and to focus and radiate heat impinging thereon and absorbed thereby downwardly toward said lower portion and the fuel being burned thereon, and means removably supporting said ignition aid assembly on said device.

11. A fuel combustion efficiency and ignition improvement device for enhancing combustion of a fuel such as wood, or the like, and supporting such fuel during combustion thereof for radiating heat forwardly therefrom to a space to be heated, said device comprising a double-walled, generally C-shaped radiation assembly constructed of relatively thin, heat absorbing steel, said assembly including complementary, spaced forward and rearward C-shaped members having a space therebetween, each of said members having a generally vertically extending back portion and generally forwardly extending upper and lower portions, means supporting said C-shaped members in an elevated position with said fuel adjacent said lower portion, each of said upper and lower portions of each of said C-shaped members having a forward end and a rearward end, said lower portion of said forward C-shaped member being subjacent said upper portion, said back portion of each of said C-shaped members being integral with and connecting said rearward ends of said upper and lower portions, said back portion with said upper and lower portions of said forward C-shaped member defining a smooth, continuous C-shaped forward surface for absorbing heat from fuel being burned amd focusing and radiating heat forwardly toward the space to be heated and towards the fuel being burned adjacent said lower portion, and heat insulating refractory material positioned in said space between said C-shaped members along substantially the full length and width of said C-shaped forward surface of said forward C-shaped member.

* * * * *